US009418612B2

(12) United States Patent
Cho et al.

(10) Patent No.: US 9,418,612 B2
(45) Date of Patent: Aug. 16, 2016

(54) LIQUID CRYSTAL DISPLAY AND METHOD FOR DRIVING THE SAME

(71) Applicant: LG Display Co., Ltd., Seoul (KR)

(72) Inventors: Soondong Cho, Gumi-si (KR); Minki Kim, Gyeongbuk (KR); Juno Hur, Daegu (KR); Dongju Kim, Busan (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/514,074

(22) Filed: Oct. 14, 2014

(65) Prior Publication Data

US 2015/0187319 A1 Jul. 2, 2015

(30) Foreign Application Priority Data

Dec. 31, 2013 (KR) ..... 10-2013-0169469

(51) Int. Cl.
*G09G 3/36* (2006.01)

(52) U.S. Cl.
CPC ..... *G09G 3/3648* (2013.01); *G09G 3/3614* (2013.01); *G09G 2320/0613* (2013.01); *G09G 2330/023* (2013.01); *G09G 2330/12* (2013.01)

(58) Field of Classification Search
CPC . G09G 3/3614; G09G 3/3648; G09G 3/3688; G09G 2330/021
See application file for complete search history.

(56) References Cited

U.S. PATENT DOCUMENTS 6,583,615 B1 * 6/2003 Kathol ..... G01D 5/485 324/207.12
2009/0185105 A1 * 7/2009 Hasegawa ..... H05B 41/2855 349/61
2010/0033467 A1 * 2/2010 Park ..... H02M 3/155 345/211
2011/0273109 A1 * 11/2011 Park ..... G09G 3/3225 315/291
2013/0283082 A1 * 10/2013 Shor ..... G06F 1/3287 713/324
2014/0042933 A1 * 2/2014 Livschitz ..... H05B 33/0848 315/307
2014/0062449 A1 * 3/2014 Qu ..... G05F 3/02 323/311

* cited by examiner

*Primary Examiner* — Ricardo L Osorio
(74) *Attorney, Agent, or Firm* — Fenwick & West LLP

(57) ABSTRACT

A liquid crystal display is disclosed. The liquid crystal display includes a power module, which senses an input voltage and outputs a mode conversion signal when the input voltage is equal to or less than a reference voltage, and a timing controller which changes a driving mode of a source driver integrated circuit (IC) in response to receiving the mode conversion signal from the power module.

5 Claims, 6 Drawing Sheets

FIG. 4

| | R | G | B | R | G | B | R | G | B | R | G | B | R | G | B | R | G | B | R | G | B | R | G | B |
|---|---|---|---|---|---|---|---|---|---|---|---|---|---|---|---|---|---|---|---|---|---|---|---|---|
| LINE #1 | + | − | + | − | + | − | + | − | + | − | + | − | + | − | + | − | + | − | + | − | + | − | + | − |
| LINE #2 | − | + | − | + | − | + | − | + | − | + | − | + | − | + | − | + | − | + | − | + | − | + | − | + |
| LINE #3 | + | − | + | − | + | − | + | − | + | − | + | − | + | − | + | − | + | − | + | − | + | − | + | − |
| LINE #4 | − | + | − | + | − | + | − | + | − | + | − | + | − | + | − | + | − | + | − | + | − | + | − | + |
| LINE #5 | + | − | + | − | + | − | + | − | + | − | + | − | + | − | + | − | + | − | + | − | + | − | + | − |
| LINE #6 | − | + | − | + | − | + | − | + | − | + | − | + | − | + | − | + | − | + | − | + | − | + | − | + |
| LINE #7 | + | − | + | − | + | − | + | − | + | − | + | − | + | − | + | − | + | − | + | − | + | − | + | − |
| LINE #8 | − | + | − | + | − | + | − | + | − | + | − | + | − | + | − | + | − | + | − | + | − | + | − | + |

FIG. 5

| | R | G | B | R | G | B | R | G | B | R | G | B | R | G | B | R | G | B | R | G | B | R | G | B |
|---|---|---|---|---|---|---|---|---|---|---|---|---|---|---|---|---|---|---|---|---|---|---|---|---|
| LINE #1 | − | + | + | − | − | + | + | − | − | + | + | − | − | + | + | − | − | + | + | − | − | + | + | − |
| LINE #2 | − | − | + | + | − | − | + | + | − | − | + | + | − | − | + | + | − | − | + | + | − | − | + | + |
| LINE #3 | − | + | + | − | − | + | + | − | − | + | + | − | − | + | + | − | − | + | + | − | − | + | + | − |
| LINE #4 | − | − | + | + | − | − | + | + | − | − | + | + | − | − | + | + | − | − | + | + | − | − | + | + |
| LINE #5 | − | + | + | − | − | + | + | − | − | + | + | − | − | + | + | − | − | + | + | − | − | + | + | − |
| LINE #6 | − | − | + | + | − | − | + | + | − | − | + | + | − | − | + | + | − | − | + | + | − | − | + | + |
| LINE #7 | − | + | + | − | − | + | + | − | − | + | + | − | − | + | + | − | − | + | + | − | − | + | + | − |
| LINE #8 | − | − | + | + | − | − | + | + | − | − | + | + | − | − | + | + | − | − | + | + | − | − | + | + |

| | R | G | B | R | G | B | R | G | B | R | G | B | R | G | B | R | G | B | R | G | B | R | G | B |
|---|---|---|---|---|---|---|---|---|---|---|---|---|---|---|---|---|---|---|---|---|---|---|---|---|
| LINE #1 | + | − | + | − | + | − | + | − | + | − | + | − | + | − | + | − | + | − | + | − | + | − | + | − |
| LINE #2 | + | − | + | − | + | − | + | − | + | − | + | − | + | − | + | − | + | − | + | − | + | − | + | − |
| LINE #3 | − | + | − | + | − | + | − | + | − | + | − | + | − | + | − | + | − | + | − | + | − | + | − | + |
| LINE #4 | − | + | − | + | − | + | − | + | − | + | − | + | − | + | − | + | − | + | − | + | − | + | − | + |
| LINE #5 | + | − | + | − | + | − | + | − | + | − | + | − | + | − | + | − | + | − | + | − | + | − | + | − |
| LINE #6 | + | − | + | − | + | − | + | − | + | − | + | − | + | − | + | − | + | − | + | − | + | − | + | − |
| LINE #7 | − | + | − | + | − | + | − | + | − | + | − | + | − | + | − | + | − | + | − | + | − | + | − | + |
| LINE #8 | − | + | − | + | − | + | − | + | − | + | − | + | − | + | − | + | − | + | − | + | − | + | − | + |

LIQUID CRYSTAL DISPLAY AND METHOD FOR DRIVING THE SAME

This application claims the benefit of Korea Patent Application No. 10-2013-0169469 filed on Dec. 31, 2013, which is incorporated herein by reference for all purposes as if fully set forth herein.

BACKGROUND OF THE INVENTION

1. Field of the Invention

Embodiments of the invention relate to a liquid crystal display and a method for driving the same capable of reducing power consumption.

2. Discussion of the Related Art

A liquid crystal display is a display device representing a luminance using the fact that an amount of light transmitted by a liquid crystal layer varies depending on a deflection degree of liquid crystals oriented on a liquid crystal display panel. An active matrix liquid crystal display, in which pixels, defined by crossings of gate lines and data lines, are disposed in a matrix form and a switching element and a pixel electrode are formed in each pixel, has been widely used as the liquid crystal display.

Recently, as the size of the liquid crystal display becomes larger and various patterns of the liquid crystal display panel are minutely formed, a load and a driving frequency have been increasing. In particular, heat generation and power consumption of the liquid crystal display have become a main problem of a source driver integrated circuit (IC). Thus, methods for solving the problem of an increase in the heat generation and the power consumption of the liquid crystal display have been proposed.

There are technologies for changing a driving method based on a pattern of an input image as a method for improving the power consumption of the liquid crystal display. Examples of the technologies include Korean Publication No. 10-2013-0015354 (hereinafter referred to as "related art"), which discloses a technology for modulating data of a black gray level or data of a white gray level when a problem pattern is input. The related art discloses a method for improving power consumption of a liquid crystal display using a phenomenon in which the power consumption varies depending on a pattern of an image. The technologies for improving the power consumption of the liquid crystal display using a pattern of the input image as in the above-described related art require a change in the internal configuration of a timing controller. Thus, because the related liquid crystal display art for reducing the power consumption have to redesign the timing controller in conformity with the respective liquid crystal displays, the related liquid crystal display art has a limit in the compatibility of the timing controller. Further, the related liquid crystal display art additionally require a memory for storing an input image pattern. The power consumption may vary depending on a driving method of the source driver IC even if the same input image pattern is input. Namely, the timing controller has to be previously redesigned based on the driving method of the source driver IC, so as to change the driving method of the source driver IC based on the input image pattern as in the related art.

SUMMARY OF THE INVENTION

Embodiments of the invention provide a liquid crystal display capable of reducing power consumption while adopting various driving methods of source driver integrated circuits (ICs).

Embodiments of the invention also provide a liquid crystal display capable of reducing power consumption without adding a memory.

In one aspect, there is a liquid crystal display including a power module configured to sense an input voltage and output a mode conversion signal when the input voltage is equal to or less than a reference voltage, and a timing controller configured to change a driving mode of a source driver integrated circuit (IC) in response to receiving the mode conversion signal from the power module.

As described above, the embodiments of the invention may reduce power consumption of the liquid crystal display by changing a driving method through a simple method without analyzing an input pattern.

Further, the embodiments of the invention may reduce the power consumption of the liquid crystal display through simple configuration without adding a memory.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 4 shows polarities of pixels in a horizontal 1-dot inversion scheme;

FIG. 5 shows polarities of pixels in a horizontal 2-dot inversion scheme;

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

An exemplary embodiment of the invention is described using a liquid crystal display as an example of a display device. However, the embodiment of the invention may be applied to a display device, such as an organic light emitting display, a field emission display (FED), a plasma display panel (PDP), and an electrophoresis display (EPD).

The liquid crystal display according to the embodiment of the invention may be implemented as any type liquid crystal display including a transmissive liquid crystal display, a transflective liquid crystal display, and a reflective liquid crystal display. The transmissive liquid crystal display and the transflective liquid crystal display require a backlight unit. A vertical electric field driving manner such as a twisted nematic (TN) mode and a vertical alignment (VA) mode or a horizontal electric field driving manner such as an in-plane switching (IPS) mode and a fringe field switching (FFS) mode may be applied to the embodiments of the invention. All of liquid crystal modes, which are currently known, may be applied to the embodiments of the invention. Further, the embodiments of the invention describe the liquid crystal display of a gate-in panel (GIP) structure, but may be applied to a liquid crystal display including gate driver integrated circuits (ICs).

Figure 1:
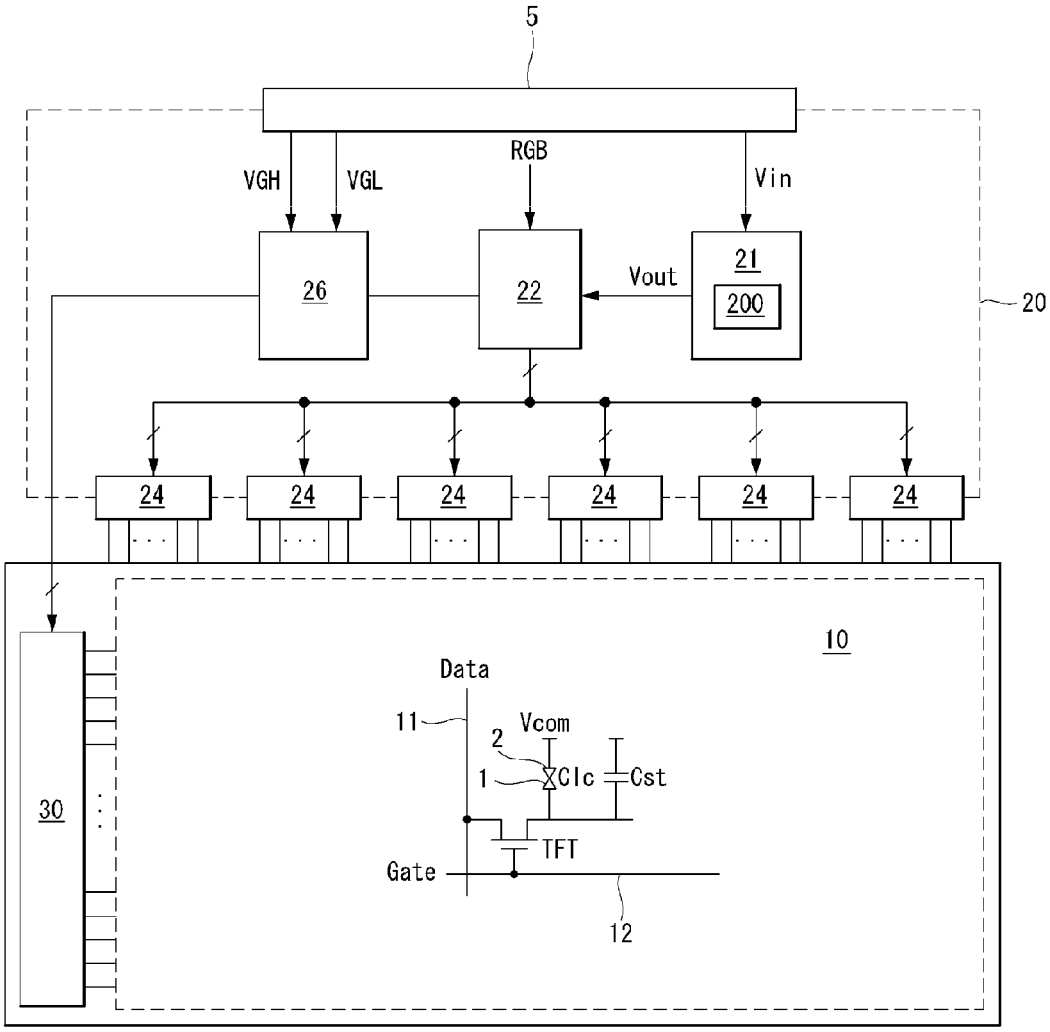
FIG. 1 shows a liquid crystal display according to an exemplary embodiment of the invention.

FIG. 1 shows a liquid crystal display according to an exemplary embodiment of the invention.

As shown in FIG. 1, the liquid crystal display according to an embodiment of the invention includes a display panel 10, a power module 21, a timing controller 22, source driver ICs 24, level shifter 26 and shift resistor 30.

The display panel 10 includes a pixel array including pixels arranged in a matrix form and displays input image data. The pixel array includes a thin film transistor (TFT) array formed on a lower substrate of the display panel 10, a color filter array formed on an upper substrate of the display panel 10, and liquid crystal cells Clc formed between the lower substrate and the upper substrate. The TFT array includes data lines 11, gate lines (or scan lines) 12 crossing the data lines 11, TFTs which are respectively formed at crossings of the data lines 11 and the gate lines 12, pixel electrodes 1 connected to the TFTs, storage capacitors Cst, etc. The color filter array includes black matrixes and color filters. Common electrodes 2 may be formed on the lower substrate or the upper substrate of the display panel 10. The liquid crystal cells Clc are driven by an electric field between the pixel electrodes 1, to which a data voltage is supplied, and the common electrodes 2, to which a common voltage Vcom is supplied. Polarizing plates, of which optical axes are perpendicular to each other, are respectively attached to the upper and lower substrates of the display panel 10. Alignment layers for setting a pre-tilt angle of liquid crystals at an interface contacting a liquid crystal layer are respectively formed on the upper and lower substrates of the display panel 10. A spacer is disposed between the upper substrate and the lower substrate of the display panel 10 to keep a cell gap of the liquid crystal layer constant.

The power module 21 starts to operate when an input voltage Vin of the power module 21 supplied through a connector 5 is equal to or greater than a predetermined level of under voltage lockout (UVLO), and generates an output after a predetermined time passed. The output of the power module 21 includes VGH, VGL, VCC, VDD, HVDD, RST, etc. In the embodiment, VGH is a high logic voltage of a gate pulse which is set to be equal to or greater than a threshold voltage of the TFTs of the pixel array, and VGL is a high logic voltage of a gate pulse which is set to be less than the threshold voltage of the TFTs of the pixel array. VCC is a logic power voltage for driving the timing controller 22 and source driver ICs 24 and may be about 3.3V. VDD and HVDD are a high potential power voltage and a half high potential power voltage, which will be supplied to a voltage divider of a gamma reference voltage generating circuit for generating positive and negative gamma reference voltages. The positive and negative gamma reference voltages are supplied to the source driver ICs 24. RST is a reset signal for resetting the timing controller 22 and may be about 3.3V.

The power module 21 compares a magnitude of the input voltage Vin supplied through the connector 5 with a reference voltage Vref and outputs a mode conversion signal when the input voltage Vin is equal to or less than the reference voltage Vref.

Figure 2:
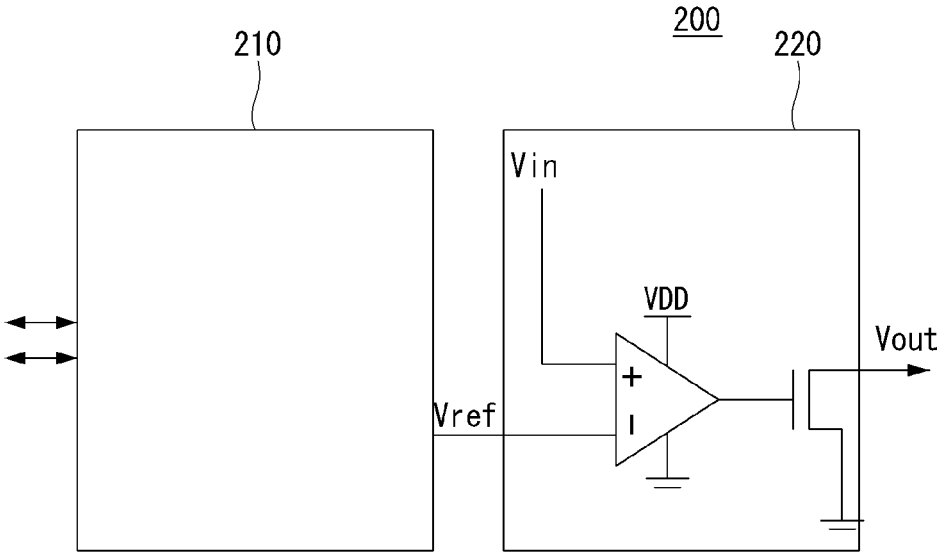
FIG. 2 shows a voltage sensing circuit according to an exemplary embodiment of the invention.

For this, the power module 21 includes a voltage sensing unit 200 as shown in FIG. 2. The voltage sensing unit 200 includes a reference voltage generator 210 and a comparator 220.

The reference voltage generator 210 generates the reference voltage Vref. The reference voltage Vref is a standard for deciding a dropping phenomenon of the input voltage Vin and is a setting value for deciding that the dropping phenomenon of the input voltage Vin is generated depending on an overload of the source driver IC 24. A drop phenomenon of the input voltage Vin supplied to the power module 21 is generated by a current consumed in the source driver ICs 24. For example, when a polarity of the data voltage output by the source driver IC 24 is changed, a potential of an output voltage of the source driver IC 24 and a potential of the common voltage Vcom are transitioned. As the transition number of the potential of the output voltage of the source driver IC 24 or the potential of the common voltage Vcom increases, electric power output by the power module 21 increases. Further, when the electric power output by the power module 21 increases, a current of the power module 21 provided by the connector 5 increases. The voltage drop is generated in a line resistance between an input terminal of the power module 21 and the connector 5 in proportion to a magnitude of the current input to the power module 21. As a result, the voltage drop phenomenon, in which a magnitude of the input voltage Vin of the power module 21 is reduced in proportion to the transition number of the potential of the output voltage of the source driver IC 24 or the potential of the common voltage Vcom, is generated.

The reference voltage Vref is a reference value for deciding the voltage drop phenomenon of the input voltage Vin. The reference voltage Vref may be set in consideration of the magnitude of the input voltage Vin and may be set to be less than the input voltage Vin. For example, when the input voltage Vin is 3.3V, the reference voltage Vref may be set to about 80% to 95% of the input voltage Vin. For instance, when the input voltage Vin is 3.3V, the reference voltage Vref may be set to about 2.8V.

The comparator 220 compares the reference voltage Vref with the input voltage Vin. When the input voltage Vin is equal to or less than the reference voltage Vref, the comparator 220 outputs a mode conversion signal Vout to the timing controller 22.

The timing controller 22 receives the digital video data RGB and timing signals, such as a vertical sync signal Vsync, a horizontal sync signal Hsync, a data enable signal DE, and a main clock CLK, from an external host system through the connector 5. The timing controller 22 transmits the digital video data RGB to the source driver ICs 24. The timing controller 22 generates a source timing control signal for controlling operation timings of the source driver ICs 24 and gate timing control signals ST, GCLK and MCLK for controlling operation timings of the level shifter 26 and the shift register 30 of the GIP type gate driving circuit using the timing signals Vsync, Hsync, DE and CLK.

The timing controller 22 operates a power consumption saving mode in response to the mode conversion signal Vout received from the power module 21. The power consumption saving mode is performed by changing a driving method of the source driver ICs 24. For example, the power consumption saving mode is performed by changing a polarity inversion period or by switching between operations of a charge share mode and a high impedance mode (hereinafter referred to as "Hi-Z mode").

The source driver ICs 24 receive digital video data RGB from the timing controller 22. The source driver ICs 24 convert the digital video data RGB into positive and negative analog data voltages in response to the source timing control signal received from the timing controller 22. The source driver ICs 24 then supply the data voltages to the data lines 11 of the display panel 10, so that the data voltages are synchronized with a gate pulse (or scan pulse). The source driver ICs 24 may be connected to the data lines 11 of the display panel 10 through a chip-on glass (COG) process or a tape automated bonding (TAB) process.

The timing controller 22, the level shifter 26, and the power module 21 are mounted on the PCB 20.

The level shifter 26 receives a start pulse ST, a first clock GCLK, a second clock MCLK, etc. from the timing controller 22. Further, the level shifter 26 receives a driving voltage including a gate high voltage VGH, a gate low voltage VGL, etc. The start pulse ST, the first clock GCLK, and the second clock MCLK swing between 0V and 3.3V. The level shifter 26 outputs a start pulse VST and clock signals CLK1 to CLK6, each of which swings between the gate high voltage VGH and the gate low voltage VGL, in response to the start pulse ST, the first clock GCLK, and the second clock MCLK received from the timing controller 22. The clock signals CLK1 to CLK6 outputted from the level shifter 26 are sequentially phase-shifted and are transmitted to the shift register 30 formed on the display panel 10.

The shift register 30 is connected to the gate lines 12 of the display panel 10. The shift register 30 includes a plurality of cascade-connected stages. The shift register 30 shifts the start pulse VST received from the level shifter 26 in response to the clock signals CLK1 to CLK6 and sequentially supplies the gate pulse to the gate lines 12.

Figure 3:
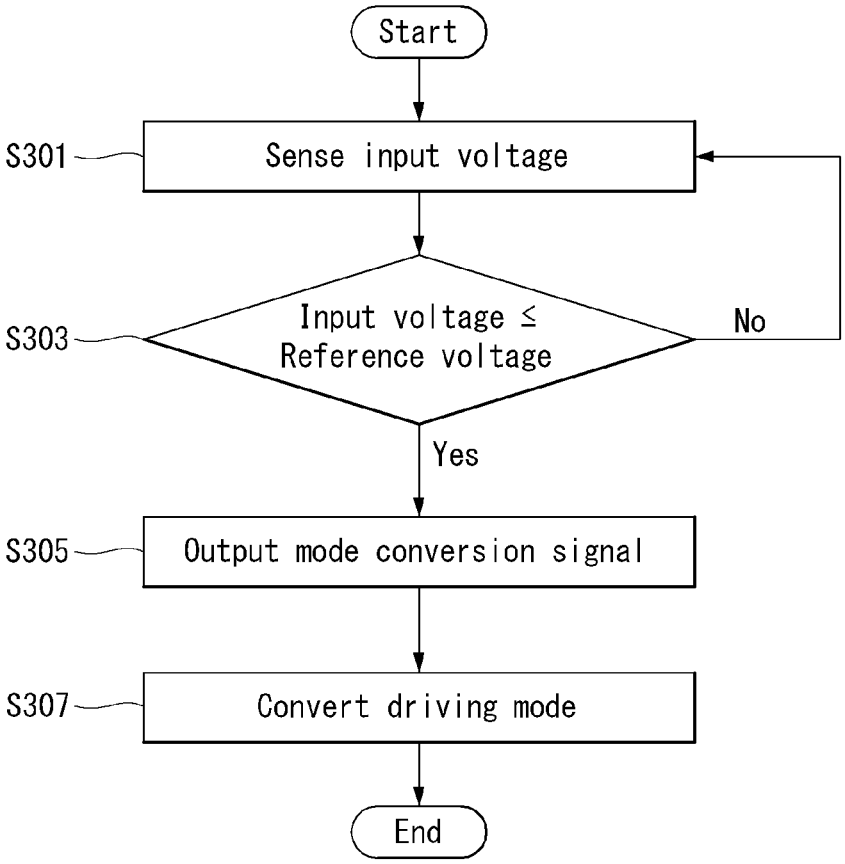
FIG. 3 is a flow chart showing a method for driving a liquid crystal display according to an exemplary embodiment of the invention.

FIG. 3 is a flow chart showing a method for selecting the power consumption saving mode of the liquid crystal display according to the embodiment of the invention.

The voltage sensing unit 200 of the power module 21 senses the input voltage Vin supplied through the connector 5 in step S301.

The comparator 220 of the voltage sensing unit 200 compares the input voltage Vin with the reference voltage Vref in step S303.

The comparator 220 outputs the mode conversion signal Vout to the timing controller 22 in step S305 when the input voltage Vin is equal to or less than the reference voltage Vref while comparing the input voltage Vin with the reference voltage Vref in real time.

The timing controller 22 changes a driving mode of the source driver ICs 24 in response to the mode conversion signal Vout in step S307.

As described above, the timing controller 22 according to an embodiment of the invention changes the driving mode of the source driver ICs 24 when the input voltage Vin of the power module 21 is equal to or less than the reference voltage Vref. The input voltage Vin of the power module 21 is related to a load of the source driver ICs 24, the transition number of data voltage, and the transition number of common voltage Vcom. When the transition number of data voltage or the transition number of common voltage Vcom increases or the load of the source driver ICs 24 increases, a load of the power module 21 increases. Hence, the dropping phenomenon of the input voltage Vin supplied to the power module 21 is generated. In this instance, the power consumption increases in proportion to the transition number of data voltage or the transition number of common voltage Vcom.

In an embodiment of the invention, it is considered that the dropping phenomenon of the input voltage Vin of the power module 21 is generated because of an increase in the transition number of source driver IC 24. The timing controller 22 changes the driving mode, so as to prevent the power consumption from increasing in proportion to the transition number of source driver IC 24.

The timing controller 22 according to a first embodiment of the invention selects one of a horizontal 1-dot inversion scheme and a horizontal 2-dot inversion scheme in response to the mode conversion signal Vout. For example, when the source driver ICs 24 are driven in the horizontal 1-dot inversion scheme, the timing controller 22 changes a polarity inversion period in response to receiving the mode conversion signal Vout, so that the source driver ICs 24 are driven in the horizontal 2-dot inversion scheme.

The timing controller 22 may perform the horizontal 1-dot inversion drive having the polarity pattern shown in FIG. 4 until the mode conversion signal Vout is transmitted to the timing controller 22. Because the display quality in the horizontal 1-dot inversion scheme may be maintained better than other dot inversion schemes, the timing controller 22 performs the horizontal 1-dot inversion drive until the mode conversion signal Vout is transmitted to the timing controller 22.

When the power consumption increases due to a predetermined pattern in the process for performing the general horizontal 1-dot inversion drive, the timing controller 22 changes the horizontal 1-dot inversion scheme into the horizontal 2-dot inversion scheme having the polarity pattern shown in FIG. 5. Hence, the power consumption may be reduced by reducing the load of the source driver ICs 24.

The timing controller 22 according to a second embodiment of the invention changes a power control (PWRC) method in response to the mode conversion signal Vout. The PWRC method is a method for controlling electric power at an output buffer and selects one of a normal mode drive and a low power consumption mode drive by setting a value of the signal outputted by an option pin. The timing controller 22 changes the driving method of the source driver ICs 24 performing the normal mode drive to the low power consumption mode drive in response to the mode conversion signal Vout. Hence, the timing controller 22 may reduce the power consumption of the source driver ICs 24.

The timing controller 22 according to a third embodiment of the invention selects one of the charge share mode and the high impedance (Hi-Z) mode in response to the mode conversion signal Vout. For example, when the source driver ICs 24 operate in the charge share mode, the timing controller 22 controls the source driver ICs 24 in response to the mode conversion signal Vout, so that the source driver ICs 24 are driven in the Hi-Z mode.

Figure 6:
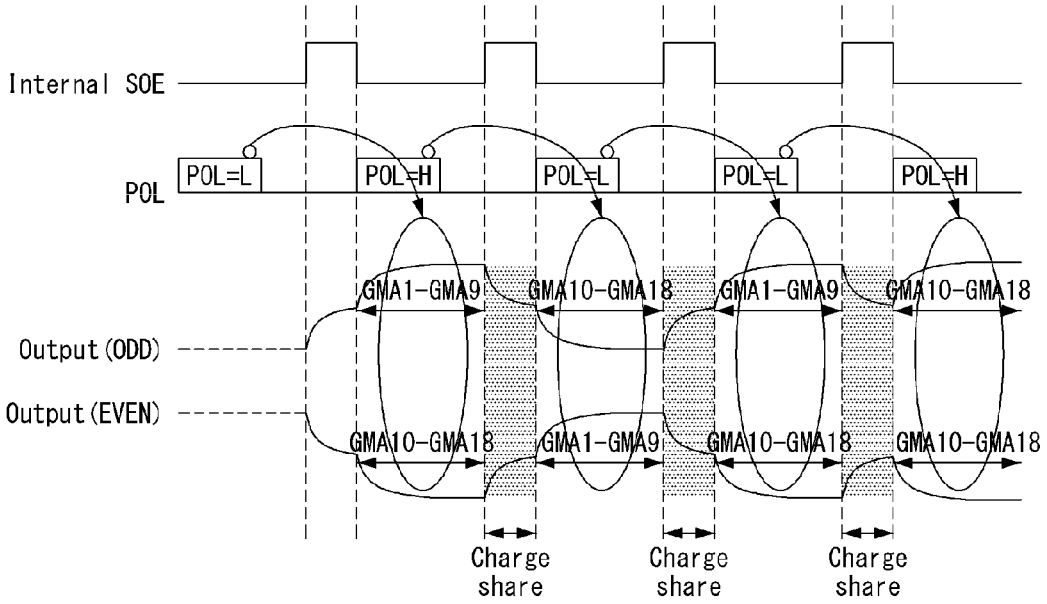
FIG. 6 illustrates a timing diagram of mechanism for driving pixels in a charge share mode.
Figures 7, 8:
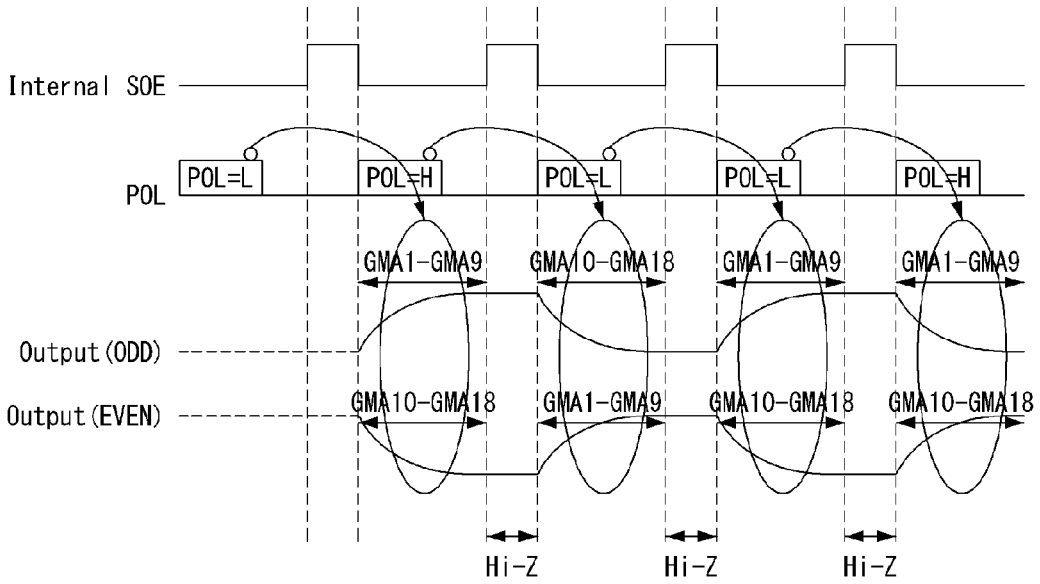
FIG. 7 illustrates a timing diagram of mechanism for driving pixels in a high impedance mode.
FIG. 8 shows polarities of pixels in a vertical 2-dot inversion scheme.

FIG. 6 illustrates a timing diagram in the Hi-Z mode, and FIG. 7 illustrates a timing diagram in the charge share mode.

In a charge share driving method, a switch connected between adjacent output channels of the source driver ICs 24 is turned on, and positive charges and negative charges in the display panel 10 are shared with each other. Hence, an output level of the data driving circuit is changed to a common voltage level. The charge share driving method is a method for reducing the power consumption and may be generally applied to the driving method for source driver ICs 24. Namely, the source driver ICs 24 may use the charge share driving method until the mode conversion signal Vout is transmitted to the timing controller 22.

However, the charge share driving method increases the transition number of data and thus may cause an increase in the power consumption. As described above, when the power consumption increases due to the charge share driving method, the timing controller 22 receives the mode conversion signal Vout and stops the charge share driving method. In this instance, the timing controller 22 may change the charge share mode into the Hi-Z mode.

As described above, the timing controller 22 may change the charge share mode into the Hi-Z mode in response to the mode conversion signal Vout, thereby preventing an increase in the power consumption resulting from an increase in the transition number of source driver ICs 24.

Alternatively, the timing controller 22 according to the third embodiment of the invention may change the Hi-Z mode into the charge share mode in response to the mode conversion signal Vout.

The timing controller 22 according to a fourth embodiment of the invention may select one of a vertical 1-dot inversion scheme and a vertical 2-dot inversion scheme in response to the mode conversion signal Vout. For example, when the source driver ICs 24 are driven in the vertical 2-dot inversion scheme, the timing controller 22 may change a polarity inversion period in response to the mode conversion signal Vout, so that the source driver ICs 24 are driven in the vertical 1-dot inversion scheme.

As shown in FIG. 8, when data of a predetermined pattern is input to the liquid crystal display driven in the vertical 2-dot inversion scheme, the polarity deflection of pixels (or subpixels), which are simultaneously charged to the data voltages by the same gate pulse, may excessively appear. Alternatively, the transition number of source driver IC 24 may increase.

Hence, the dropping phenomenon of the input voltage Vin of the power module 21 may be generated. The power module 21 outputs the mode conversion signal Vout to the timing controller 22 when the dropping phenomenon of the input voltage Vin is generated. The timing controller 22 may change the vertical 2-dot inversion scheme into the vertical 1-dot inversion scheme in response to the mode conversion signal Vout. For example, the driving method may be changed to a horizontal 2-dot scheme of FIG. 5 and vertical 1-dot inversion.

The above-described first to fourth embodiments of the invention may be individually performed, and also may be implemented through a combination of two or more driving modes.

Furthermore, the embodiment of the invention may be variously applied to an example where the timing controller 22 changes the driving mode of the source driver ICs 24. The embodiment of the invention is described using the horizontal 2-dot inversion scheme capable of reducing the power consumption as an example of the driving method. However, the horizontal 1-dot inversion scheme capable of reducing the power consumption may be used depending on characteristics of the display panel or characteristics of the source driver ICs 24.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a power module configured to sense an input voltage and output a mode conversion signal when the input voltage is equal to or less than a reference voltage; and a timing controller configured to select one of a high impedance mode and a charge share mode in response to receiving the mode conversion signal, and to change a driving mode of a source driver integrated circuit (IC) in response to receiving the mode conversion signal from the power module.

2. The liquid crystal display of claim 1, wherein the power module includes:

a reference voltage generator configured to generate the reference voltage; and a comparator configured to receive the reference voltage and the input voltage and output the mode conversion signal when the input voltage is equal to or less than the reference voltage.

3. The liquid crystal display of claim 1, wherein the timing controller changes a polarity inversion period in response to receiving the mode conversion signal.

4. The liquid crystal display of claim 3, wherein the timing controller selects one of a horizontal 1-dot inversion scheme and a horizontal 2-dot inversion scheme in response to receiving the mode conversion signal.

5. The liquid crystal display of claim 3, wherein the timing controller selects one of a vertical 1-dot inversion scheme and a vertical 2-dot inversion scheme in response to receiving the mode conversion signal.

* * * * *